US008608868B2

(12) United States Patent
Hwang et al.

(10) Patent No.: US 8,608,868 B2
(45) Date of Patent: Dec. 17, 2013

(54) METHOD FOR IMPROVING SURFACE MECHANICAL PROPERTIES OF NON-AUSTENITIC STAINLESS STEELS

(75) Inventors: Kuen-Shyang Hwang, Taipei (TW); Li-Hui Cheng, Taipei (TW); Yung-Chung Lu, Taoyuan County (TW); Yang-Liang Fan, Taoyuan County (TW); Po-Han Chen, Taoyuan County (TW)

(73) Assignee: Taiwan Powder Technologies Co., Ltd., Taoyuan County (TW)

( * ) Notice: Subject to any disclaimer, the term of this patent is extended or adjusted under 35 U.S.C. 154(b) by 312 days.

(21) Appl. No.: 13/081,960

(22) Filed: Apr. 7, 2011

(65) Prior Publication Data

US 2012/0255652 A1 Oct. 11, 2012

(51) Int. Cl.
*C23C 8/22* (2006.01)
*C23C 8/30* (2006.01)

(52) U.S. Cl.
USPC ..... 148/218; 148/225

(58) Field of Classification Search
USPC ..... 148/218, 225, 206
See application file for complete search history.

(56) References Cited

U.S. PATENT DOCUMENTS

| | | | |
|---|---|---|---|
| 5,556,483 | A | 9/1996 | Tahara et al. |
| 5,593,510 | A | 1/1997 | Tahara et al. |
| 5,792,282 | A | 8/1998 | Tahara et al. |
| 6,093,303 | A | 7/2000 | Williams et al. |
| 6,461,448 | B1 | 10/2002 | Williams et al. |
| 6,547,888 | B1 | 4/2003 | Williams et al. |
| 7,468,107 | B2 | 12/2008 | Tipps et al. |

*Primary Examiner* — Jessee Roe
(74) *Attorney, Agent, or Firm* — Muncy, Geissler, Olds & Lowe, PLLC

(57) ABSTRACT

A method for improving surface mechanical properties of non-austenitic stainless steels comprises steps of: providing a non-austenitic stainless steel material; placing the non-austenitic stainless steel material in an environment containing at least one austenite-stabilizing element, and implanting the austenite-stabilizing elements into a surface of the non-austenitic stainless steel material to form a modified layer enriched with the austenite-stabilizing elements; and placing the non-austenitic stainless steel material in a carbon-bearing atmosphere to make the modified layer in contact with the carbon-bearing atmosphere, and maintaining the non-austenitic stainless steel material at a carburizing temperature below 600° C. to implant carbon into the modified layer to form a carburized layer. The carburized layer enhances the surface hardness of the non-austenitic stainless steel material and enables it to apply to decorative components or structural components demanding high abrasion resistance, high surface hardness, and high corrosion resistance.

17 Claims, 2 Drawing Sheets

METHOD FOR IMPROVING SURFACE MECHANICAL PROPERTIES OF NON-AUSTENITIC STAINLESS STEELS

FIELD OF THE INVENTION

The present invention relates to a method for improving surface mechanical properties of non-austenitic stainless steels, particularly to a method which improves the surface mechanical properties of non-austenitic stainless steels through a low-temperature carburization process.

BACKGROUND OF THE INVENTION

According to the crystallographic structures, the stainless steels can be categorized into the austenitic type, the martensitic type, and the ferritic type. Stainless steels have superior corrosion resistance and are suitable to be used as structural or decorative parts, such as screws, nuts, shafts, pins, decorative accessories, and casings of watches, mobile phones, electronic products and electric appliances. However, the surface hardness and wear resistance of the traditional stainless steels are usually unable to meet application requirements. For example, 316L stainless steel, a designation of AISI (American Iron and Steel Institute), which contains 15-18 wt % Cr, 12-15 wt % Ni, 2-3 wt % Mo, and the balance of iron and impurities, has a hardness of HRB50-70, and the surface thereof is likely to be damaged by abrasion or collision.

A nitriding method or a carburizing method is usually used to generate nitride or increase the concentration of carbon in the surface of a stainless steel workpiece so as to enhance the surface hardness. The carburizing method, in particular, is extensively used in the industry. Normally, stainless steel is carburized in a carbon-bearing atmosphere at a specified temperature for a long period of time. Thereby, carbon atoms can implant into the surface of a workpiece to form a carburized layer. In a U.S. Pat. No. 7,468,107, a stainless steel workpiece is carburized in a methane-bearing atmosphere at a temperature of 1,900-2,000° F. At such high a temperature (over 980° C.), the chromium in stainless steels is likely to react with carbon in the methane-bearing atmosphere. Thus, the amount of dissolved chromium in the surface of the stainless steel workpiece decreases, and the corrosion resistance of the stainless steel workpiece degrades. Accordingly, the carburizing temperature of 316L stainless steel workpiece is preferred to be below the nose in the continuous cooling transformation (CCT) diagram shown in FIG. 1.

The surface of the stainless steel workpiece usually has a passive layer hindering implanation of carbon atoms and impairing formation of a carburized layer when carburization is undertaken at a temperature below the nose temperature. Therefore, the passive layer should be removed before low-temperature carburization. U.S. Pat. Nos. 5,792,282, 5,556,483, and 5,593,510 disclosed a carburization method for austenitic stainless steel, wherein stainless steel is placed in a fluorine- or fluoride-bearing atmosphere at a temperature of 250-450° C. for tens of minutes to convert the passive layer into a fluorinated layer. Next, stainless steel is carburized at a temperature of 400-500° C. Carbon atoms can more easily pass through the fluorinated layer than the passive layer containing chromium oxide. Thus, the carburized depth may reach about 20 μm, and the hardness may reach about HV800, in the abovementioned prior arts.

A U.S. Pat. No. 6,547,888 disclosed modified low-temperature case hardening processes, wherein stainless steel is placed in an $N_2$ atmosphere containing 20 vol % HCl at a temperature of 550° F. for 60 minutes to activate the passive layer. Then, the stainless steel is carburized at a temperature of 880-980° F. In addition, U.S. Pat. Nos. 6,461,448 and 6,093,303 disclosed other low temperature case hardening processes, wherein stainless steel is placed in a fusion salt bath containing a mixture of a cyanide salt, a metal halide salt, and calcium carbide, wherein the cyanide salt and the metal halide salt are used to activate the passive layer of stainless steels, and wherein calcium carbide is the carbon source for carburization.

However, the abovementioned carburizing methods are only suitable for the austenitic stainless steels, which have high solid solubility of carbon. The non-austenitic stainless steels, such as the martensitic stainless steel and the ferritic stainless steel, have low solid solubility of carbon atoms and are hard to be carburized.

At present, the industry usually adopts a solid-solution strengthening method or an age-hardening method to enhance the mechanical properties of the non-austenitic stainless steels. However, the abovementioned two methods cannot effectively improve the surface mechanical properties (such as hardness and wear resistance) of the non-austenitic stainless steels. Thus, the non-austenitic stainless steels are hard to apply to the workpieces demanding high wear resistance or high surface hardness.

SUMMARY OF THE INVENTION

The primary objective of the present invention is to overcome the problem: the conventional methods for improving the mechanical properties of the non-austenitic stainless steels cannot effectively enhance the surface mechanical properties.

To achieve the abovementioned objective, the present invention proposes a method for improving surface mechanical properties of non-austenitic stainless steels, which comprises steps of: providing a non-austenitic stainless steel material; placing the non-austenitic stainless steel material in an environment containing at least one austenite-stabilizing element, and applying a driving force to implant the austenite-stabilizing elements into the surface of the non-austenitic stainless steel material to form a modified surface layer enriched with austenite-stabilizing elements; placing the non-austenitic stainless steel material in a carbon-bearing atmosphere to make the modified layer in contact with the carbon-bearing atmosphere, and maintaining the non-austenitic stainless steel material at a carburizing temperature below 600° C. to implant carbon into the modified surface layer to form a carburized layer.

The method of the present invention has the following characteristics:

1. The present invention firstly forms a modified layer rich in austenite-stabilizing elements on the surface of a non-austenitic stainless steel material. Next, carbon atoms are implanted into the modified layer at a temperature below 600° C. to form a carburized layer to greatly enhance the surface mechanical properties of the non-austenitic stainless steel material.
2. The carburized layer is formed at a temperature below 600° C. In the temperature range, chromium would not react with carbon, so that chromium carbide will not form. Thus, superior corrosion resistance is still preserved in the carburized non-austenitic stainless steel material.

DETAILED DESCRIPTION OF THE PREFERRED EMBODIMENTS

Below, the technical contents of the present invention are described in detail in cooperation with drawings.

Figure 1:
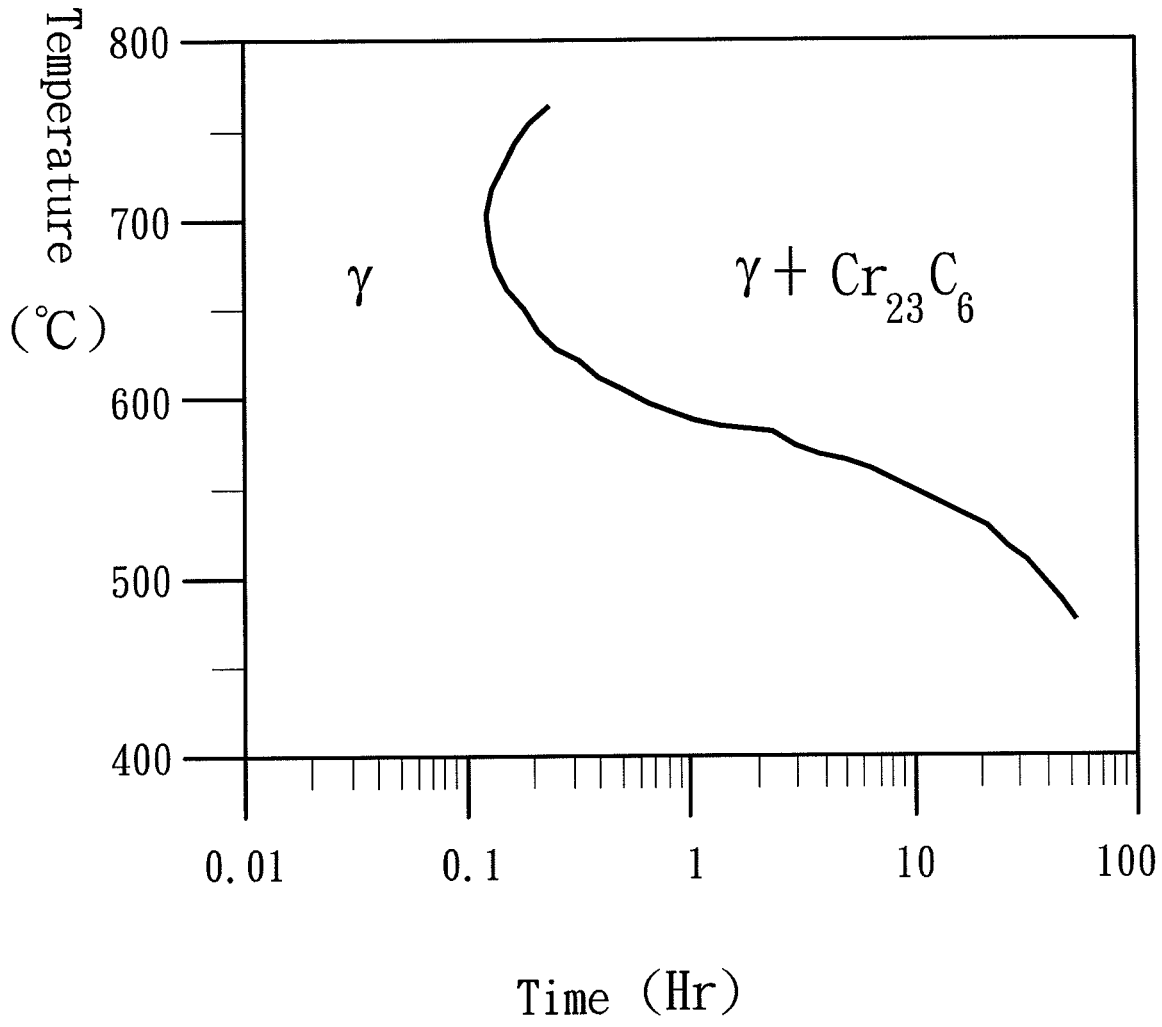
Fig. 1 PRIOR ART
FIG. 1 is a diagram showing a continuous cooling transformation (CCT) curve of 316L stainless steel.
Figure 2:
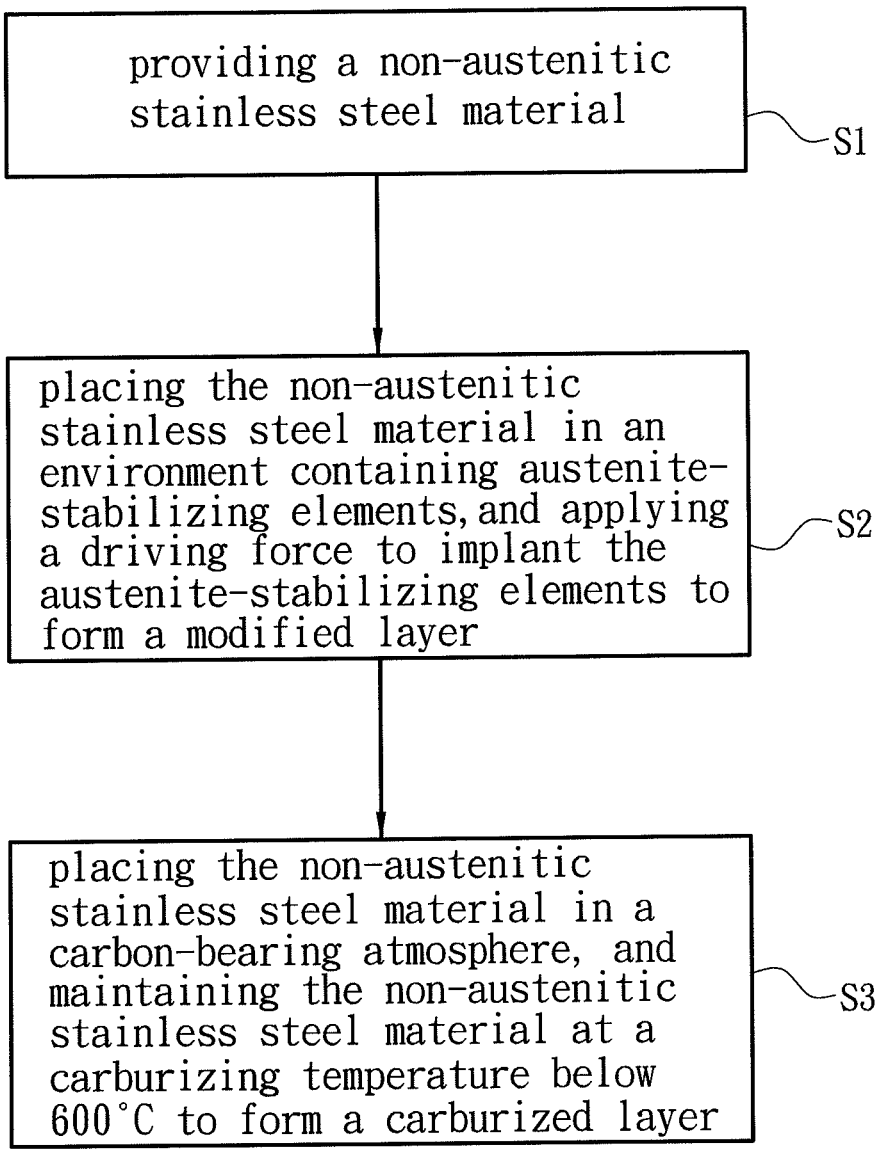
FIG. 2 is a flowchart of a method for improving surface mechanical properties of non-austenitic stainless steels according to one embodiment of the present invention.

FIG. 2 shows a flowchart of a method for improving surface mechanical properties of non-austenitic stainless steels according to one embodiment of the present invention. In Step S1, a non-austenitic stainless steel material is provided. The non-austenitic stainless steel material is an iron-based material containing less than 2.0 wt % carbon, less than 1.0 wt % silicon, less than 2.0 wt % manganese, 12.0-19.0 wt % chromium, less than 15.0 wt % nickel, less than 6.0 wt % molybdenum, and less than 6.0 wt % copper. The non-austenitic stainless steel material is a martensitic stainless steel material or a ferritic stainless steel material. In one embodiment, the non-austenitic stainless steel material is a 17-4 PH precipitation hardening stainless steel. The stainless steel material is fabricated with a forging or casting process. Alternatively, a green compact is obtained with a Metal Injection Molding (MIM) process or a powder compaction process. Then, the green compact is placed in a reducing environment and sintered at a temperature of 1,050-1,400° C. to obtain the stainless steel material. The reducing environment is a vacuum environment, a nitrogen-bearing atmosphere or a hydrogen-bearing atmosphere.

In Step S2, a modified surface layer is formed in the surface of the non-austenitic stainless steel material. The non-austenitic stainless steel material is placed in an environment containing at least one austenite-stabilizing element (ASE). Next, a driving force is applied to implant the ASE into the surface of the non-austenitic stainless steel material to form a modified layer rich in the ASE. In the present invention, the ASE is an element able to stabilize austenite and may be nitrogen, carbon, copper, nickel, manganese, cobalt, or aluminum.

In one embodiment, the ASE-bearing environment is a nitrogen-bearing atmosphere, and the driving force is a temperature of 1,050-1,400° C. The non-austenitic stainless steel material may be placed in an atmosphere sintering furnace, and a cracked ammonia-bearing atmosphere or an atmosphere containing hydrogen and nitrogen is supplied to the sintering furnace. Thereby, the nitrogen-bearing atmosphere surrounds the non-austenitic stainless steel material. Next, the atmosphere furnace is heated to the abovementioned temperature and maintained at the temperature for 30 minutes to 3 hours. Next, the atmosphere furnace is cooled to an ambient temperature, and the non-austenitic stainless steel is taken out from the atmosphere furnace. Thus a passive layer originally existing on the surface of the non-austenitic stainless steel is removed and an ASE-rich modified layer is formed on the surface of the non-austenitic stainless steel material.

In one embodiment, the ASE-bearing environment is an electrolyte solution containing copper, nickel, manganese, or aluminum, and the driving force is an electric potential difference applied to an electrode and the non-austenitic stainless steel material. Firstly, the non-austenitic stainless steel is placed in an electrolysis bath containing the solution of electrolyte. The electrolyte may be nickel sulfate, nickel phosphate, nickel phosphite, or nickel chloride. In the electrolyte solution, an electrode made of a material selected from a group consisting of pure ASE (copper, nickel, manganese, and aluminum) or the alloys, is placed. The electrode and the non-austenitic stainless steel are connected with a power source. The power source is applied to the electrode and the non-austenitic stainless steel material, whereby the ASE contained in the electrode are dissociated from the electrode into the electrolyte solution and deposited on the surface of the non-austenitic stainless steel material. Thus an ASE-rich modified layer is formed on the surface of the non-austenitic stainless steel material.

In one embodiment, after being formed on the surface of the non-austenitic stainless steel material, the modified layer is further homogenized, wherein the non-austenitic stainless steel material is placed in a reducing environment and homogenized at a temperature of 1,050-1,400° C. The reducing environment is a vacuum environment or a hydrogen-bearing atmosphere. The homogenization may be undertaken in a vacuum furnace or an atmosphere sintering furnace. Firstly, the non-austenitic stainless steel material is placed in an atmosphere sintering furnace. Next, the atmosphere sintering furnace is supplied with cracked ammonia or a gas mixture of hydrogen and nitrogen. Next, the atmosphere sintering furnace is heated to a homogenization temperature and maintained at the temperature for a given period of time. Next, the atmosphere sintering furnace is cooled to an ambient temperature. Then, the non-austenitic stainless steel material is taken out from the furnace. Alternatively, the non-austenitic stainless steel material is placed in a vacuum furnace. Next, the vacuum furnace is pumped to a given degree of vacuum and heated to a homogenization temperature and maintained at the temperature for a given period of time. Next, the vacuum furnace is cooled to an ambient temperature. Then, the non-austenitic stainless steel material is taken out from the vacuum furnace. The given period of time ranges from 30 minutes to 3 hours. After homogenization, the ASE is more uniformly distributed in the modified surface layer of the non-austenitic stainless steel.

In Step S3 a carburizing process is undertaken. The non-austenitic stainless steel material containing the modified surface layer is taken to contact a carbon-bearing atmosphere and maintained at a carburizing temperature, whereby carbon atoms can implant into the modified layer on the surface of the non-austenitic stainless steel to form a carburized layer. The carburizing temperature is lower than 600° C. and preferred to be 400-580° C. In the present invention, the carbon-bearing atmosphere may be an atmosphere containing carbon monoxide, methane, or propane. In one embodiment, the non-austenitic stainless steel containing the modified surface layer is placed in a carburizing furnace filled with a carbon-bearing atmosphere; the carburizing furnace is heated to a temperature of 400-580° C. and maintained at the temperature for a given period of time. The carburization time is preferably 24 hours. Next, the carburizing furnace is cooled to an ambient temperature, and the non-austenitic stainless steel material is taken out from the carburizing furnace. Thus, a carburized layer is formed on the surface of the non-austenitic stainless steel and the thickness of the carburized layer is 10-50 μm.

Below, the below embodiments are used to demonstrate the method for improving surface mechanical properties of non-austenitic stainless steels of the present invention. However, the embodiments are only to exemplify the present invention but not to limit the scope of the present invention. Table.1 lists the chemical compositions of the stainless steels used in the embodiments and comparisons, wherein Composition 1 belongs to a commercial 17-4PH stainless steel workpiece, and wherein Composition 2 belongs to a commercial 17-4PH stainless steel powder. The 17-4PH stainless steel powder is fabricated into a green compact with a MIM process. The green compact is further sintered to form a sintered body.

Herein, the non-austenitic stainless steel materials are only exemplified with the commercial 17-4PH stainless steel workpiece and a sintered body made from the commercial 17-4PH stainless steel powder. However, the samples may also be made of another non-austenitic stainless steel.

In the embodiments and comparisons, the stainless steel workpieces of Composition 1 are carburized according to the fabrication conditions listed in Table.2. In Embodiments I and II, a commercial 17-4PH stainless steel workpiece is placed in an atmosphere sintering furnace filled with cracked ammonia and maintained at a temperature to form a nitrogen-rich layer on the surface of the commercial 17-4PH stainless steel workpiece; then the commercial 17-4PH stainless steel workpiece containing the modified layer is carburized. In Embodiments III-V, a commercial 17-4PH stainless steel workpiece is placed in a nickel-bearing electrolyte solution; an electric potential difference is applied to deposit nickel on the surface of the commercial 17-4PH stainless steel workpiece to form a nickel-plated layer; then the commercial 17-4PH stainless steel workpiece containing the nickel-plated layer is homogenized and then carburized. In Embodiments VI and VII, a commercial 17-4PH stainless steel sintered body is placed in a nickel-bearing electrolyte solution; an electric potential difference is applied to deposit nickel on the surface of the commercial 17-4PH stainless steel sintered body to form a nickel-plated layer; then the commercial 17-4PH stainless steel sintered body containing the nickel-plated layer is homogenized and then carburized. The thicknesses of the nickel-plated layers are measured via observing microscopic images.

After carburization, the stainless steel workpieces are examined for the hardness, corrosion resistance, and the thickness of the carburized layer. The hardness tests include the surface hardness and the core hardness of the workpieces and the sintered bodies and are performed using a Vickers hardness tester. The corrosion resistance is realized by the Metal Powder Industries Federation (MPIF) Standard 62 and a frequently-used salt-spray method. In the MPIF Standard 62, the carburized workpieces are immersed in a 2 wt % sulfuric acid solution for 24 hours. Then, the weight loss is measured. If the weight loss per square decimeter is less than 0.005 g, the workpiece is a qualified one and designated by O. If the weight loss per square decimeter is greater than 0.005 g, the workpiece is an unqualified one and designated by X. The carburized workpieces are also tested with the salt-spray method, wherein the carburized workpieces are placed in a mist of 5 wt % sodium chloride solution and observed with the naked eyes to determine the interval of time after which corrosion occurs. The thickness of the carburized layer is measured via observing the microscopic images of the carburized workpieces.

Embodiment I

A stainless steel workpiece of Composition 1 is used as the sample in this embodiment. The stainless steel workpiece is placed in an atmosphere sintering furnace filled with cracked ammonia and maintained at a temperature of 1,320° C. for 2 hours to form on the surface of the stainless steel workpiece a nitrogen-rich modified layer having a thickness of about 50 μm. Next, the stainless steel workpiece is taken out from the atmosphere sintering furnace and placed in a carburizing furnace filled with carbon monoxide. The carburizing furnace is heated to a temperature of 500° C. and maintained at the temperature for 24 hours. Thus, a carburized layer having a thickness of about 21 μm is formed on the surface of the stainless steel workpiece. The carburized stainless steel workpiece has a surface hardness of about HV650 and a core hardness of about HV370. The carburized stainless steel workpiece has qualified corrosion resistance and tolerates the salt spray test for 40 hours.

Embodiment II

A stainless steel workpiece of Composition 1 is used as the sample in this embodiment. The stainless steel workpiece is placed in an atmosphere sintering furnace filled with cracked ammonia and maintained at a temperature of 1,120° C. for 2 hours to form on the surface of the stainless steel workpiece a nitrogen-rich modified layer having a thickness of about 35 μm. Next, the stainless steel workpiece is taken out from the atmosphere sintering furnace and placed in a carburizing furnace filled with carbon monoxide. The carburizing furnace is heated to a temperature of 500° C. and maintained at the temperature for 24 hours. Thus, a carburized layer having a thickness of about 20 μm is formed on the surface of the stainless steel workpiece. The carburized stainless steel workpiece has a surface hardness of about HV653 and a core hardness of about HV365. The carburized stainless steel workpiece has qualified corrosion resistance and tolerates the salt spray test for 40 hours.

Embodiment III

A stainless steel workpiece of Composition 1 is used as the sample in this embodiment. A nickel layer having a thickness of about 0.5 μm is plated on the surface of the stainless steel workpiece. Next, the nickel layer is homogenized. The stainless steel workpiece is placed in an atmosphere sintering furnace filled with cracked ammonia and maintained at a temperature of 1,320° C. for 2 hours. Next, the atmosphere sintering furnace is cooled to an ambient temperature. Next, the stainless steel workpiece is taken out from the atmosphere sintering furnace and placed in a carburizing furnace filled with carbon monoxide. The carburizing furnace is heated to a temperature of 500° C. and maintained at the temperature for 24 hours. Thus, a carburized layer having a thickness of about 25 μm is formed on the surface of the stainless steel workpiece. The carburized stainless steel workpiece has a surface hardness of about HV710 and a core hardness of about HV350. The carburized stainless steel workpiece has qualified corrosion resistance and tolerates the salt spray test for 42 hours.

Embodiment IV

A stainless steel workpiece of Composition 1 is used as the sample in this embodiment. The stainless steel workpiece is placed in an electrolyte solution to plate a nickel layer having a thickness of about 0.5 μm on the surface of the stainless steel workpiece. Next, the nickel layer is homogenized. The stainless steel workpiece is placed in an atmosphere sintering furnace filled with cracked ammonia and maintained at a temperature of 1,120° C. for 2 hours. Next, the atmosphere sintering furnace is cooled to an ambient temperature. Next, the stainless steel workpiece is taken out from the atmosphere sintering furnace and placed in a carburizing furnace filled with carbon monoxide. The carburizing furnace is heated to a temperature of 500° C. and maintained at the temperature for 24 hours. Thus, a carburized layer having a thickness of about 22 μm is formed on the surface of the stainless steel workpiece. The carburized stainless steel workpiece has a surface hardness of about HV695 and a core hardness of about HV350. The carburized stainless steel workpiece has qualified corrosion resistance and tolerates the salt spray test for 42 hours.

Embodiment V

A stainless steel workpiece of Composition 1 is used as the sample in this embodiment. The stainless steel workpiece is placed in an electrolyte solution to plate a nickel layer having a thickness of about 0.5 μm on the surface of the stainless steel workpiece. Next, the nickel layer is homogenized. The stainless steel workpiece is placed in a vacuum furnace and maintained at a temperature of 1,320° C. for 2 hours. Next, the vacuum furnace is cooled to an ambient temperature. Next, the stainless steel workpiece is taken out from the vacuum furnace and placed in a carburizing furnace filled with carbon monoxide. The carburizing furnace is heated to a temperature of 500° C. and maintained at the temperature for 24 hours. Thus, a carburized layer having a thickness of about 23 μm is formed on the surface of the stainless steel workpiece. The carburized stainless steel workpiece has a surface hardness of about HV680 and a core hardness of about HV322. The carburized stainless steel workpiece has qualified corrosion resistance and tolerates the salt spray test for 42 hours.

Embodiment VI

In this embodiment, the stainless steel powder of Composition 2 is fabricated into a green compact in a MIM process. Next, the stainless steel workpiece is placed in a vacuum environment at a temperature of 1,320° C. for 2 hours to form a sintered body having a relative density as high as 96%. Next, the sintered body is placed in an electrolyte solution to plate on the surface of the sintered body a nickel layer having a thickness of about 0.5 μm. Next, the nickel layer is homogenized. The sintered-and-plated body is placed in an atmosphere sintering furnace filled with cracked ammonia and maintained at a temperature of 1,320° C. for 2 hours. Next, the atmosphere sintering furnace is cooled to an ambient temperature. Next, the sintered body is taken out from the atmosphere sintering furnace and placed in a carburizing furnace filled with carbon monoxide. The carburizing furnace is heated to a temperature of 500° C. and maintained at the temperature for 24 hours. Thus, a carburized layer having a thickness of about 25 μm is formed on the surface of the sintered body. The carburized sintered body has a surface hardness of about HV720 and a core hardness of about HV302. The carburized sintered body has qualified corrosion resistance and tolerates the salt spray test for 38 hours.

Embodiment VII

In this embodiment, the stainless steel powder of Composition 2 is fabricated into a green compact in a MIM process. Next, the stainless steel workpiece is placed in a vacuum environment at a temperature of 1,320° C. for 2 hours to form a sintered body having a relative density as high as 96%. Next, the sintered body is placed in an electrolyte solution to plate on the surface of the sintered body a nickel layer having a thickness of about 0.5 μm. Next, the nickel layer is homogenized. The sintered-and-plated body is placed in a vacuum furnace and maintained at a temperature of 1,320° C. for 2 hours. Next, the vacuum furnace is cooled to an ambient temperature. Next, the sintered body is taken out from the vacuum furnace and placed in a carburizing furnace filled with carbon monoxide. The carburizing furnace is heated to a temperature of 500° C. and maintained at the temperature for 24 hours. Thus, a carburized layer having a thickness of about 22 μm is formed on the surface of the sintered body. The carburized sintered body has a surface hardness of about HV680 and a core hardness of about HV300. The carburized sintered body has qualified corrosion resistance and tolerates the salt spray test for 38 hours.

Comparison I

A stainless steel workpiece of Composition 1 is used as the sample in this comparison. The stainless steel workpiece is placed in a carburizing furnace filled with carbon monoxide. The carburizing furnace is heated to a temperature of 500° C. and maintained at the temperature for 24 hours. No carburized layer is formed on the surface of the stainless steel workpiece. The stainless steel workpiece has a surface hardness of HV350 and a core hardness of HV352. The stainless steel workpiece has qualified corrosion resistance and tolerates the salt spray test for 35 hours.

Comparison II

In this comparison, the stainless steel powder of Composition 2 is sintered in a vacuum environment at a temperature of 1,320° C. for 2 hours to form a sintered body having a relative density of 96%. The sintered body is placed in a carburizing furnace filled with carbon monoxide. The carburizing furnace is heated to a temperature of 500° C. and maintained at the temperature for 24 hours. Thus, a carburized layer having a thickness of about 11 μm is formed on the surface of the sintered body. The carburized sintered body has a surface hardness of about HV610 and a core hardness of about HV250. The carburized sintered body has qualified corrosion resistance and tolerates the salt spray test for 35 hours.

In Embodiments I-VII, the carburized layer may be as thick as about 25 μm, which can be further increased by increasing the carburization time. Further, Embodiments I-VII prove that the present invention can enhance the maximum surface hardness to about HV720. In the comparison using a stainless steel workpiece, no carburized layer is formed on the surface; the surface hardness thereof almost equals the core hardness. In the comparison using a stainless steel powder, the sintered body has a carburized layer of about 11 μm, which is much thinner than the carburized layers in the embodiments; the surface hardness thereof is only increased to about HV610, which is much lower than those in the embodiments; the core hardness thereof is also lower than those in the embodiments.

In conclusion, the method for improving surface mechanical properties of non-austenitic stainless steels of the present invention is characterized in that a modified surface layer, which is rich in austenite-stabilizing elements, is formed on the surface of a non-austenitic stainless steel. Thus, carbon atoms can implant into the modified layer more easily, and a carburized layer is formed in the modified layer. Thereby the surface hardness of non-austenitic stainless steels is enhanced. In the present invention, carburization is undertaken at a temperature of 400-580° C. In the abovementioned temperature range, chromium would not precipitate from stainless steel. Therefore, the present invention can preserve superior resistance of stainless steel. Further, the present invention does not use a halide-bearing gas or solution to activate the passive layer. Therefore, the present invention neither harms human bodies nor damages the environment. Furthermore, the present invention uses simpler equipment and has lower fabrication cost in comparison with the conventional low-temperature carburization process.

The embodiments described above are only to exemplify the present invention but not to limit the scope of the present invention. Any equivalent modification or variation according to the spirit of the present invention is to be also included within the scope of the present invention.

FIG. 2

S1 providing a non-austenitic stainless steel material

S2 placing the non-austenitic stainless steel material in an environment containing austenite-stabilizing elements, and applying a driving force to implant the austenite-stabilizing elements to form a modified layer S3 placing the non-austenitic stainless steel material in a carbon-bearing atmosphere, and maintaining the non-austenitic stainless steel material at a carburizing temperature below 600° C. to form a carburized layer

TABLE 1

Chemical Compositions Used in Embodiments and Comparisons (Weight Percentage)

| Serial Number | C | Si | Mn | Cr | Mo | Ni | Cu | Nb | P | S | Fe |
|---|---|---|---|---|---|---|---|---|---|---|---|
| Composition 1 | 0.04 | 0.82 | 0.88 | 15.70 | 0.01 | 4.05 | 3.81 | 0.28 | 0.018 | 0.008 | balance |
| Composition 2 | 0.04 | 0.82 | 0.82 | 15.74 | 0.01 | 4.27 | 3.26 | 0.30 | 0.018 | 0.008 | balance |

TABLE 2

Fabrication Conditions for Embodiments I-XII and Comparisons I and II

| Serial Number | Chemical Composition | Fabrication Temperature | Time | Environment | Nickel Plating Thickness | Homo-genization Temperature | Time | Environ-ment | Carb-urization Temperature | C-containing Atmosphere | time |
|---|---|---|---|---|---|---|---|---|---|---|---|
| Embodiment 1 | Composition 1 | 1320° C. | 2 hours | cracked ammonia | — | — | — | — | 500° C. | carbon monoxide | 24 hours |
| Embodiment 2 | Composition 1 | 1120° C. | 2 hours | cracked ammonia | — | — | — | — | 500° C. | carbon monoxide | 24 hours |
| Embodiment 3 | Composition 1 | — | — | — | 0.5 μm | 1320° C. | 2 hours | cracked ammonia | 500° C. | carbon monoxide | 24 hours |
| Embodiment 4 | Composition 1 | — | — | — | 0.5 μm | 1120° C. | 2 hours | cracked ammonia | 500° C. | carbon monoxide | 24 hours |
| Embodiment 5 | Composition 1 | — | — | — | 0.5 μm | 1320° C. | 2 hours | vacuum | 500° C. | carbon monoxide | 24 hours |
| Embodiment 6 | Composition 2 | 1320° C. | 2 hours | vacuum | 0.5 μm | 1320° C. | 2 hours | cracked ammonia | 500° C. | carbon monoxide | 24 hours |
| Embodiment 7 | Composition 2 | 1320° C. | 2 hours | vacuum | 0.5 μm | 1320° C. | 2 hours | vacuum | 500° C. | carbon monoxide | 24 hours |
| Comparison 1 | Composition 1 | — | — | — | — | — | — | — | 500° C. | carbon monoxide | 24 hours |
| Comparison 2 | Composition 2 | 1320° C. | 2 hours | vacuum | — | — | — | — | 500° C. | carbon monoxide | 24 hours |

TABLE 3

Mechanical Properties and Corrosion Resistances Obtained in Embodiments I-XII and Comparisons I and II

| Serial Number | Surface Harness | Core Hardness | Carburized Depth | Corrosion Resistance Test | Salt Spray Test |
|---|---|---|---|---|---|
| Embodiment 1 | HV 650 | HV 370 | 21 μm | O | 40 hours |
| Embodiment 2 | HV 653 | HV 365 | 20 μm | O | 40 hours |
| Embodiment 3 | HV 710 | HV 350 | 25 μm | O | 42 hours |
| Embodiment 4 | HV 695 | HV 350 | 24 μm | O | 42 hours |
| Embodiment 5 | HV 680 | HV 322 | 23 μm | O | 42 hours |
| Embodiment 6 | HV 720 | HV 302 | 25 μm | O | 38 hours |
| Embodiment 7 | HV 680 | HV 300 | 22 μm | O | 38 hours |
| Comparison 1 | HV 350 | HV 352 | 0 μm | O | 35 hours |
| Comparison 2 | HV 610 | HV 250 | 11 μm | O | 35 hours |

What is claimed is:

1. A method for improving surface mechanical properties of non-austenitic stainless steels comprising the steps of:

providing a non-austenitic stainless steel material;

placing the non-austenitic stainless steel material in an environment containing at least one austenite-stabilizing element, and applying a driving force to implant the at least one austenite-stabilizing element into a surface of the non-austenitic stainless steel material to form a modified layer rich in the at least one austenite-stabilizing element; and placing the non-austenitic stainless steel material in a carbon-bearing atmosphere to make the modified layer in contact with the carbon-bearing atmosphere, and maintaining the non-austenitic stainless steel material at a carburizing temperature below 600° C. to implant carbon atoms into the modified layer to form a carburized layer.

2. The method for improving surface mechanical properties of non-austenitic stainless steels according to claim 1, wherein the at least one austenite-stabilizing element is selected from a group consisting of nitrogen, copper, nickel, manganese, and aluminum.

3. The method for improving surface mechanical properties of non-austenitic stainless steels according to claim 1, wherein the carburizing temperature ranges from 400 to 580° C.

4. The method for improving surface mechanical properties of non-austenitic stainless steels according to claim 1, wherein the stainless steel material is fabricated with a Metal Injection Molding process or a powder-compaction process.

5. The method for improving surface mechanical properties of non-austenitic stainless steels according to claim 4, wherein before being placed in the environment containing at least one austenite-stabilizing element, the stainless steel material is placed in a reducing environment and sintered at a sintering temperature of 1,050-1,400° C.

6. The method for improving surface mechanical properties of non-austenitic stainless steels according to claim 5, wherein the reducing environment is a vacuum environment, a nitrogen-bearing atmosphere, or a hydrogen-bearing atmosphere.

7. The method for improving surface mechanical properties of non-austenitic stainless steels according to claim 1, wherein the stainless steel material is fabricated with a forging or casting process.

8. The method for improving surface mechanical properties of non-austenitic stainless steels according to claim 1, wherein the environment containing at least one austenite-stabilizing element is a nitrogen-bearing atmosphere, and wherein the driving force is a temperature ranging from 1,050 to 1,400° C.

9. The method for improving surface mechanical properties of non-austenitic stainless steels according to claim 8, wherein the nitrogen-bearing atmosphere is an atmosphere containing cracked ammonia or an atmosphere containing a mixture of nitrogen and hydrogen.

10. The method for improving surface mechanical properties of non-austenitic stainless steels according to claim 1, wherein the environment containing at least one austenite-stabilizing element is an electrolyte solution containing the at least one austenite-stabilizing element, and wherein the driving force is an electric potential difference applied to an electrode and the stainless steel material.

11. The method for improving surface mechanical properties of non-austenitic stainless steels according to claim 10, wherein the at least one austenite-stabilizing element is selected from a group consisting of copper, nickel, manganese, and aluminum.

12. The method for improving surface mechanical properties of non-austenitic stainless steels according to claim 10, wherein before the carburized layer is formed, the non-austenitic stainless steel material is placed in a reducing environment and maintained at a homogenization temperature of 1,050-1,400° C.

13. The method for improving surface mechanical properties of non-austenitic stainless steels according to claim 12, wherein the reducing environment is a vacuum environment or a hydrogen-bearing atmosphere.

14. The method for improving surface mechanical properties of non-austenitic stainless steels according to claim 1, wherein the carbon-bearing atmosphere contains a carbon source selected from a group consisting of carbon monoxide, methane and propane.

15. The method for improving surface mechanical properties of non-austenitic stainless steels according to claim 1, wherein the carburized layer has a thickness of 10-50 μm.

16. The method for improving surface mechanical properties of non-austenitic stainless steels according to claim 1, wherein the non-austenitic stainless steel material is an iron-based material containing less than 2.0 wt % carbon, less than 1.0 wt % silicon, less than 2.0 wt % manganese, 12.0-19.0 wt % chromium, less than 15.0 wt % nickel, less than 6.0 wt % molybdenum, and less than 6.0 wt % copper.

17. The method for improving surface mechanical properties of non-austenitic stainless steels according to claim 1, wherein the non-austenitic stainless steel material is a martensitic stainless steel or a ferritic stainless steel.

* * * * *